US006851126B1

(12) United States Patent
Humphreys

(10) Patent No.: US 6,851,126 B1
(45) Date of Patent: Feb. 8, 2005

(54) GHILLIE SUIT

(76) Inventor: Nathan Humphreys, 403 E. 3rd St., Rifle, CO (US) 81650

( * ) Notice: Subject to any disclaimer, the term of this patent is extended or adjusted under 35 U.S.C. 154(b) by 0 days.

(21) Appl. No.: 10/708,283

(22) Filed: Feb. 22, 2004

(51) Int. Cl.[7] ..... A41D 13/00
(52) U.S. Cl. ..... 2/69; 2/79; 2/900; 2/243.1
(58) Field of Search ..... 2/69, 69.5, 79, 2/88, 89, 80, 83, 93–95, 108, 243.1; 428/919

(56) References Cited

U.S. PATENT DOCUMENTS

| | | | | | |
|---|---|---|---|---|---|
| 33,528 | A | * | 10/1861 | Johns | 2/89 |
| 2,344,379 | A | * | 3/1944 | Wallin | 2/89 |
| 2,967,306 | A | * | 1/1961 | Fabanich | 2/94 |
| 3,661,689 | A | * | 5/1972 | Spanier | 428/33 |
| 4,158,892 | A | | 6/1979 | Gonzales | 2/69.5 |
| 4,507,805 | A | | 4/1985 | Calutoiu | 2/69.5 |
| 4,718,122 | A | | 1/1988 | Steverson | 2/70 |
| 5,274,848 | A | | 1/1994 | Shamblin | 2/69 |
| 5,281,460 | A | | 1/1994 | Cox | 428/112 |
| 5,592,691 | A | * | 1/1997 | Ronald | 2/69 |
| 6,127,007 | A | * | 10/2000 | Cox et al. | 428/15 |
| 6,460,185 | B1 | * | 10/2002 | Hardy | 2/69 |
| 6,499,141 | B1 | * | 12/2002 | Egnew | 2/69 |
| 6,500,214 | B1 | | 12/2002 | Muirhead | 8/478 |
| 6,754,910 | B2 | * | 6/2004 | Shultz et al. | 2/244 |

* cited by examiner

*Primary Examiner*—Gloria M. Hale
(74) *Attorney, Agent, or Firm*—Kyle W. Rost

(57) ABSTRACT

A net matrix defines the shape of a ghillie suit and carries elongated strips of camouflage material in sufficient numbers and arrangement to define a three-dimensional camouflage layer. A band of flexible material is woven and sewn to the perimeter of the net in order to strengthen it and carry all substantial loads or rough handling. The band is shaped to define one or more handling loops along the perimeter, especially at corners. Mechanical fasteners are attached at spaced positions along the band for configuring the ghillie suit to a human wearer and adapting for use in a larger array. The fasteners also reinforce the handling loops where the band crosses itself. An optional liner attaches to the suit by a different fastening system but also duplicates the mechanical fasteners of the main suit.

16 Claims, 9 Drawing Sheets

GHILLIE SUIT

BACKGROUND OF INVENTION

1. Technical Field

The invention generally relates to apparel. More specifically, the invention relates to body garments, which may be camouflaged, bag type, capes, trousers or hunters' garments. In greater detail, the invention is a garment of a type known as a ghillie suit, famous for providing exceptionally effective three-dimensional camouflage. An aspect of the invention relates to specific plans and methods of construction that produces a ghillie suit that can be worn as a garment or converted for alternative uses in the field, including combination with other similar ghillie suites to form broad areas of camouflage.

2. Background Art

Many hunting and military settings require the use of camouflage clothing or covers to avoid detection from either animals or an opponent. Camouflage coverings are applied to disguise individuals and to cloak equipment, supplies, vehicles and weapons. The best concealment apparel or coverings possess a natural three-dimensional camouflage effect. Such camouflage efficiently blends with background foliage, obscuring it from observation.

The ghillie suit originated in Scotland hundreds of years ago. It provides what is known as three-dimensional camouflage because it has substantial thickness. The surface is physically irregular and uneven, often formed of camouflage strips, which typically are leaf-like surface elements connected to an underlying web, net, fabric, or other substrate. Frequently, camouflage strips are cloth strips or strings tied to the substrate. In contrast, two-dimensional camouflage refers to a common flat, woven, or sheet fabric, even though it may carry a camouflage pattern. The ghillie suit can be adapted to any background environment by attaching camouflage strips of a suitable mix or colors to match the background and fade into it. The typical objective of this type of camouflage is to blend into the background and be nondescript. The objective is sometimes stated as to appear essentially as nothing, due to the blend of colors and obscured shape of the wearer. Such suits find application in many areas, including military, hunting, or any situation where an observer wishes to remain unnoticed.

In keeping with the general goal of a ghillie suit to blend into the surroundings, it is designed to be worn without establishing a distinct shape on the wearer. Often it is not worn, at all. Rather, it may be a softly shaped panel of material, and the user merely remains beneath it while the panel lies on the ground. The material typically is netting or mesh that carries the leaf-like elements or camouflage strips. This construction allows the wearer or user to see through the material without requiring shaped definition of any particular headpiece with eye openings. The wearer can lie under the panel in any location or configuration. The panel is equally suitable to serve as a blind, a tent, a covering, or a worn suit.

These many utilities and modes of use create a need for versatility in design and construction. Several designs for a convertible garment are known in patent art.

U.S. Pat. No. 6,003,747 to Sabo shows a recent garment design using a rectangular panel that stores in an attached fanny pack. The panel is formed of mesh netting and carries a system of straps and D-rings that permit various connections to be made to define different useful configurations. In one of these, part of the panel can be configured as leggings to aid mobile use, while the remainder loosely covers the upper torso. In another, the entire panel can be formed into a tube around the user. In still another, the entire panel is used off the body, staked in place as a stationary blind or tent.

U.S. Pat. No. 4,718,122 to Steverson shows a camouflaged coat that converts among several lengths. Buttons, hook-and-loop fasteners, and the like provide conversion. Other adjustments create leggings or even a coverall suit.

U.S. Pat. No. 4,507,805 to Calutoiu shows a convertible sleeping bag that can be reconfigured by use of zippers into a garment with arm and foot openings, or leggings, or sleeves. The sleeping bag may contain suspenders attached from a suitable point to help carry the garment on a wearer at comfortable height.

U.S. Pat. No. 4,158,892 to Gonzales shows another convertible sleeping bag. This garment uses a system of zippers that enable reconfiguration as sleeping bag, jump suit, jacket, or vest. As aids to use, separate foot warmers, gloves, and a belt accompany this garment.

A ghillie suit can be constructed by a variety of different techniques. The base fabric often is a mesh or net with large enough openings to permit ready attachment of the leaf-like elements. U.S. Pat. No. 6,500,214 to Muirhead provides a recent example. Strands of jute in lengths from eighteen to twenty-four inches form the leaf-like elements. The mesh or net fabric can be viewed as a grid of many individual squares. A strand of jute is tied to at least one side of each square or to as many as all four sides. The net fabric can be sized and configured as a separate garment, as an attachment for conventional clothing, or as a covering or any type of object from a rifle to a vehicle. U.S. Pat. No. 5,281,460 to Cox shows another type of attached element formed from strips of nylon. These can be sewn or glued to a mesh base. Still another proposal has suggested attaching cloth strips by snaps, as in U.S. Pat. No. 5,274,848 to Shamblin. This variety of assembly techniques shows on-going efforts to produce a realistic and cost-effective ghillie suit.

It would be desirable to create a ghillie suit that offered a high degree of versatility in its use and ability to combine with other similar suits for extended purposes.

To achieve the foregoing and other objects and in accordance with the purpose of the present invention, as embodied and broadly described herein, the camouflage device of this invention may comprise the following.

SUMMARY OF INVENTION

Against the described background, it is therefore a general object of the invention to provide an improved camouflage suit of the ghillie suit variety that is versatile in many modes of use.

Another object is to create a ghillie suit that is both light in weight and well ventilated to allow evaporation of moisture.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, an improved ghillie suit is constructed of a net matrix that defines the approximate shape of the ghillie suit. The net matrix carries elongated strips of camouflage material in sufficient numbers and arrangement to define a three-dimensional camouflage layer. A substantially continuous flexible band is attached to the net matrix at its perimeter. The band is shaped to define one or more handling loops along the perimeter. Such loops receive and dissipate handling forces over a broad area of the net matrix. The flexible band carries mechanical fasteners at positions spaced around the perimeter of the net matrix in a pattern of positions useful for adapting the ghillie suit to a human wearer and also adapting it to be engaged with other similar ghillie suits in an assembled array.

The flexible band fits through openings of the net matrix and is woven through openings along the perimeter of the matrix. The band also is sewn to the net. Different embodiments of the flexible band include a folded edge strip that contains an edge of the net within the fold, or a strap. At corners of the net, the band is looped to redirect it around the corner and form a handling loop. One of the mechanical fastening devices can be attached at the loop to secure together overlapping band portions. The preferred fastener is a snap fastener that attaches to the band by a rivet style attachment.

Different types of fastening devices are suited for use on various parts of the ghillie suit. These include snap fasteners, zippers, hook-and-loop fasteners, or any combination of them.

The improved ghillie suit is formed of either one or two distinct parts. A two-piece embodiment is formed of one part is a body garment that fits from approximately feet to chest. The second part is a hood that fits from chest to head. Each is generally rectangular and defines a top edge bounded by pair of top corners, opposite side edges, and a bottom edge. The flexible band extends along the top edge of each and forms a transitional loop at the top corners of each.

The body garment defines a partial upward leg slit from the bottom edge to define a pair of individual leg coverings. The flexible band engages the perimeter of the body garment at its side edges and at the edges of the leg slit.

The mechanical fasteners at the legs allow a variety if engagements between parts of the ghillie suit and other ghillie suits. The fasteners include leg zipper halves attached to the band at the opposite edges of the leg slit. The fasteners also include lower side zipper halves attached at the opposite side edges near the bottom edge of the body garment. The lower side zipper halves are engageable with each other, which allows a plurality of adjacently arranged ghillie suits to be attached side-by-side by using these engageable zipper portions. The leg zipper halves are engageable with each other, which allows the leg slit to be closed or opened by using these zipper portions. Each of the lower side zipper halves is engageable with the juxtaposed leg zipper half to form a leg tube.

The flexible band also carries upper side zipper halves attached at the opposite side edges near the top edge of the body garment. The upper zipper portions are useful for closing the body garment about a user. An optional breast piece is formed of a section of net fabric, carrying camouflage strips, and bordered by a flexible border band on at least its opposite side edges. The breast piece carries a zipper half on each side edge, engageable with the upper side zipper halves of said body garment. These zipper portions allow the breast piece to be attached between the upper side zipper halves and allow the body garment to be closed on a larger size user. The body garment also carries a pair of shoulder straps, located centrally on the band at the top edge of the garment. A second end of the shoulder straps also is attachable to the top edge band.

Another optional portion of the ghillie suit is a liner of substantially the same shape and dimensions as the net matrix. The perimeter of the liner carries a plurality of attachment straps that can be closed for form a loop. The attachment straps engage around the flexible band of the ghillie suit to attach the liner. The liner can be formed of a camouflage printed fabric. The liner carries fasteners in suitable positions to engage with the mechanical fasteners on the perimeter of ghillie suit. This positioning allows the liner to engage juxtaposed like ghillie suits or other liners to form a larger scale array.

The accompanying drawings, which are incorporated in and form a part of the specification illustrate preferred embodiments of the present invention, and together with the description, serve to explain the principles of the invention. In the drawings:

DETAILED DESCRIPTION

The invention is a ghillie suit or camouflage suit constructed and convertible for multi-purpose use. An assembly and method of construction creates a lightweight and well-ventilated suit that, at the same time, is rugged and highly durable in field use. Mesh or net clothing used in the field is especially subject to damage and rapid degradation from catches and snags. A durable peripheral band ensures the continued functional integrity of the suit despite field damage to net components. In addition, the peripheral band provides handling points and support points that allow the suit to function in its several different configurations. Thus, despite the difficulty of handling and wearing a three-dimensional camouflage suit, the peripheral band and its associated handling and support points enable the suit to be worn and used with considerable ease.

Figure 1:
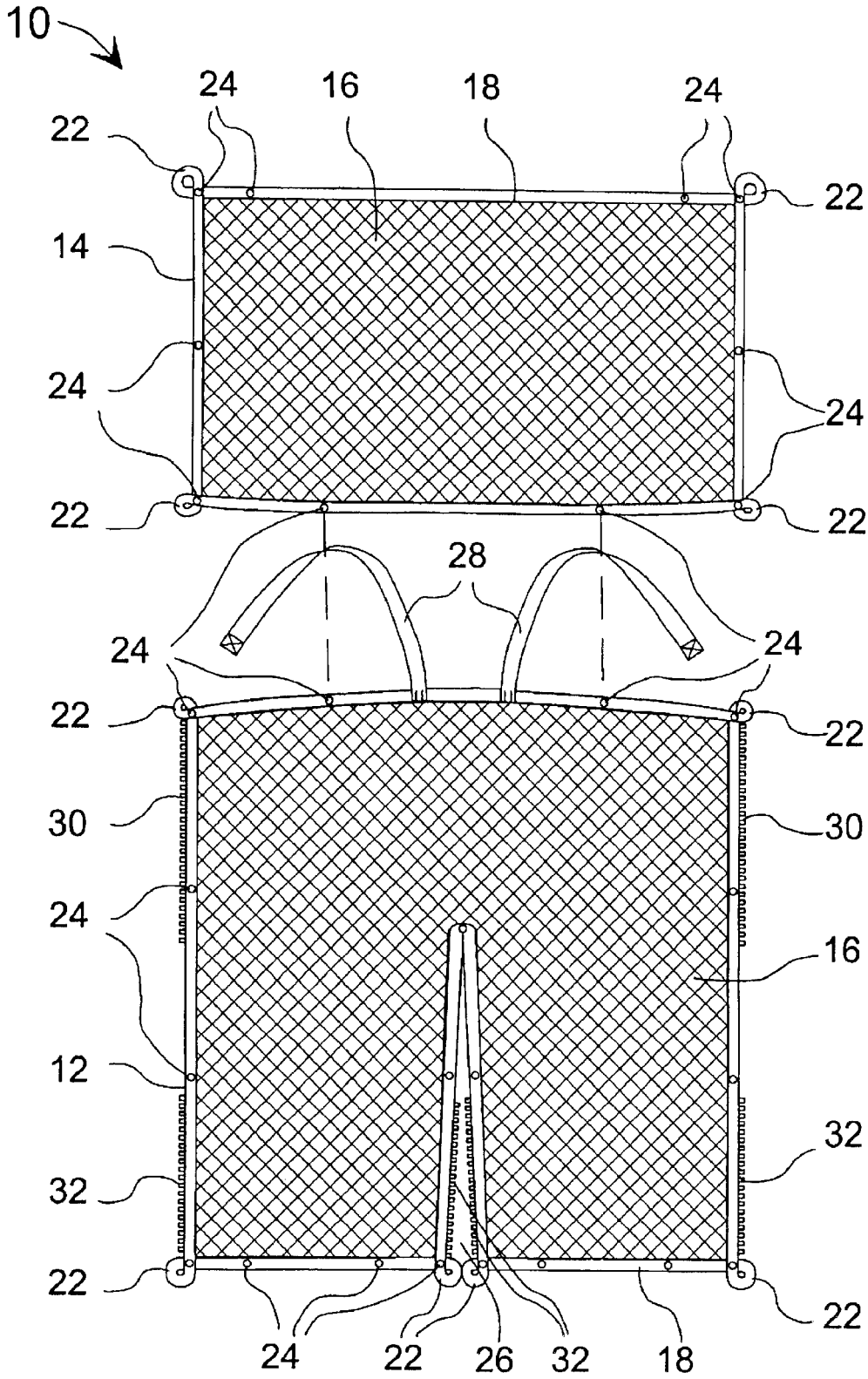
FIG. 1 is an exploded plan view of a two-piece ghillie suit in a spread-out configuration, showing the inside face, a peripheral strip, spaced peripheral zippers, and spaced peripheral snap fasteners of two portions of the suit.
Figure 7:
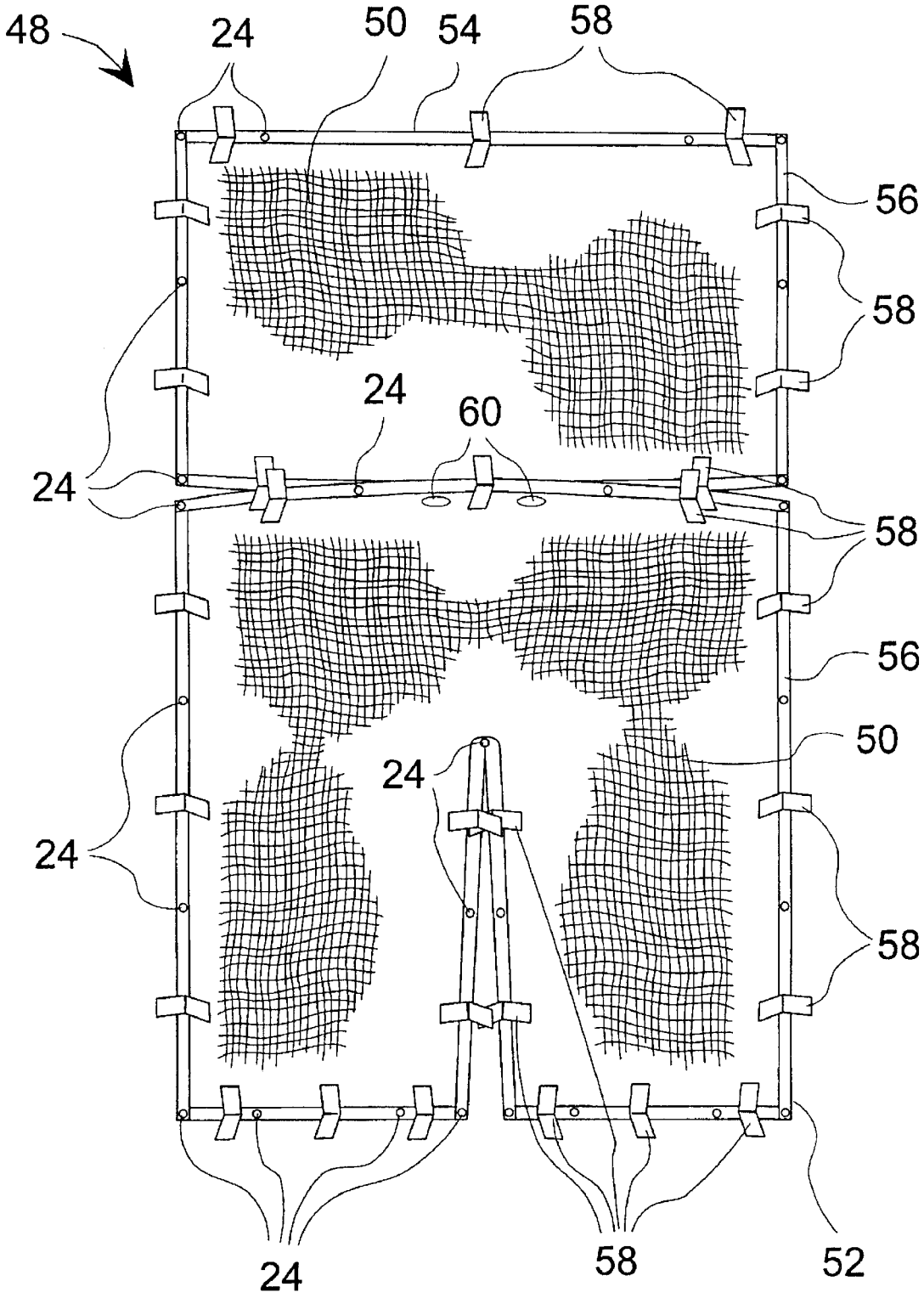
FIG. 7 is a plan view, showing an optional liner with spaced peripheral snap fasteners and spaced peripheral attachment straps.

With reference to FIG. 1, the camouflage suit 10 is shaped and sized for use as a covering tarp, an article of clothing, or a component in a larger scale array of camouflaged material. The suit 10 as a whole is generally rectangular when laid out as shown in FIG. 1. FIG. 7 shows the similar layout of a suit liner, which has the same shape and dimensions as the suit of FIG. 1, but shows it in an assembled configuration. Thus, reference by analogy to both FIGS. 1 and 7 shows how the suit 10 is assembled from two component parts into the larger complete suit 10. The width of the overall suit rectangle can be about four feet, while the length can be greater than six feet. However, as noted above, the suit is formed as two separable parts. The lower component 12 in the view of FIG. 1 is suited for use as trousers or a body garment extending from ankles to chest. The upper component 14 in FIG. 1 is suited for use as a hood, cape, or head and arm cover and will generally be referred to as the hood. The length or height of the lower component 12 can be about four feet, while the height of the hood 14 is less, such as about twenty-eight inches. These approximate sizes allow the suit 10 to fit a wide variety of wearers as a garment and provide a usefully large area for use as a tarp or sub-component of a larger assembly.

Both the body garment 12 and the hood 14 share features of construction. The main or central area of each is a matrix 16 formed of a net that is tinted or camouflage-printed in suitable colors for the intended camouflage environment. The net 16 may be constructed of nylon or polyester formed as net material. A preferred opening size is about three-quarters inch. The net matrix 16 defines the approximate shape of the ghillie suit 10, including a plurality of corner areas. The rectangular shape shown in FIGS. 1 and 7 is not critical, as other variations in shape are readily possible. Therefore, the definition of a corner should be taken broadly, as a location where the edge of the net matrix changes direction is a substantial way. Therefore, in this case a corner refers to an area of substantial redirection and may include a curve or an angle other than a right angle.

Figure 5:
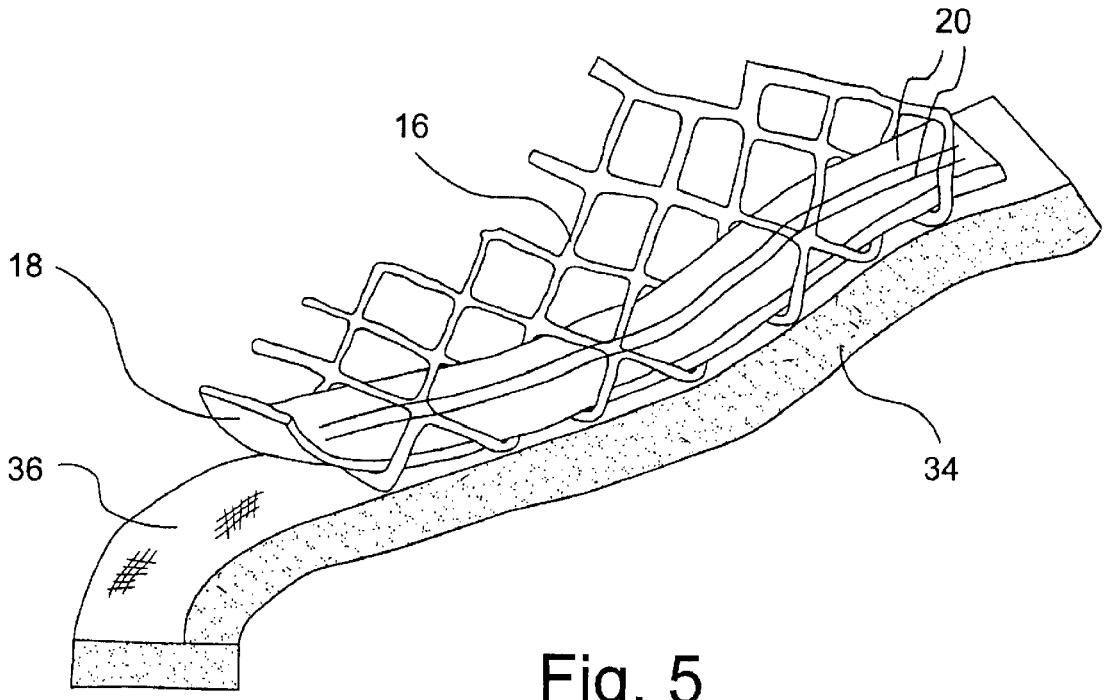
FIG. 5 is a fragmentary view of an edge of the mesh fabric, showing a connection of the mesh fabric with a peripheral strap and showing an optional peripheral attachment strip of hook-and-loop fabric.

FIG. 5 shows a typical net structure for the matrix 16. Each sheet 16 of net material is bounded on its periphery by a strong, flexible, durable, and substantially continuous perimeter element 18, which may have a width similar in dimension to an opening of the matrix. Thus, a three-quarter inch band, especially a nylon strap, is a preferred choice to serve as the perimeter element. Therefore, in further description, the perimeter element frequently and equivalently will be referred to as such a strap or band. FIG. 5 also shows a method of engagement between the net matrix and the perimeter element or strap 18. The strap is woven through a peripheral row of matrix openings, such that it sequentially passes over and under the mesh or net strings forming the openings. The strap 18 is secured in place to the net material by lines of sewing 20. The sewing lines 20 serve as the preferred means for continuously attaching the perimeter element to the perimeter of the net matrix. Sewing, glue, or like means can be used either exclusively or in combination with weaving the band 18 through the net.

All support, handling, and attachment functions are supported from the flexible band 18. FIG. 1 shows that the strap or band extends along the peripheral sides of the matrix 16 in both the upper garment 14 and lower garment 12. The band 18 forms a handling loop located at a pre-selected perimeter location for receiving and dissipating handling forces over a broad area of the net matrix. Pre-selected locations are preferred to be at some or all corners, where the strap also forms a transitional loop 22 whereby it is redirected along the next sequential edge of the matrix 16. The loops 22 may form a central opening about one and one-half inches in diameter for ready hand engagement. The loops serve as primary handling devices so that there is little need to lift or pull the suit 10 by any other part. The loops provide two combined functions, in that they redirect the strap and they provide handling aids. These two functions can be separated. Loops can be located at other selected peripheral locations for the purpose of providing handling aids. Loops can be eliminated from corners, in which case the strap 18 can be otherwise redirected around corners or cut and sewn at the desired corner angle. Thus, the important feature of the loops 22 is that they provide handling aids that dissipate force over a broad area of the net. Such forces otherwise might be applied directly to the more delicate net 16. Locating loops 22 at corners provides combined functions and is a preferred arrangement.

The peripheral element 18 carries a plurality of inter-engageable mechanical fastening devices at positions spaced around the perimeter of the net matrix. The fastening devices are arranged in a pattern of positions adapted for conforming the ghillie suit 10 to a human wearer and also adapted for engaging the ghillie suit 10 to one or more juxtaposed, like ghillie suits. One suitable variety of mechanical fasteners are snap fasteners 24, which are attached to the band 18 by rivet style bases. These are preferred to be of the double function variety having both a male and a female end. One snap fastener 24 is placed through the ends of the loop 22 or crossing point of the strap at each loop 22 to secure the strap 18 to itself and protect the fabric matrix 16. Other snap fasteners 24 are placed along the length of the strap at predefined positions to enable coordination in the fit of suit components and the fit with other suits. For example, along the top edge of the hood 14 and the bottom edge of the lower garment 12, a snap fastener is located about six inches inwardly from each corner loop 22. This placement allows the top and bottom edges of suits 10 to engage. On the side edges of the hood 14, a snap may be located near the midpoint, which is about fourteen inches from either the top or bottom corner hood loop 22.

Snap fasteners 24 may serve as the attachment means between the hood 14 and the garment 12, as shown in FIG. 1 by the dashed assembly lines. On the bottom edge of the hood 14 and on the top edge of the garment 12, a snap fastener is located about twelve inches inwardly from the corner loops 22. This placement allows the bottom edge of the hood to engage the top edge of the garment 12.

With respect to the sides of the lower garment 12, two snap fasteners may be placed equidistantly between the top and bottom corner loops 22. Thus, one snap fastener is located about sixteen inches below the top corner loop 22, and another is located about sixteen inches above the bottom corner loop 22.

The body garment 12 is adapted to be reconfigured into chaps or trouser leg tubes and worn suspended from the wearer's shoulders. The lower edge of the garment 12 is configured with an upwardly extending leg slit 26 that divides the lower portion of the garment 12 into left and right leg coverings. A slit length of about thirty inches is suitable, thus defining a thirty-inch inseam. The inseam at each periphery of the slit is protected by the addition of strap 18, described above. In addition, the strap on the slit 26 carries snap fasteners 24 at predetermined locations, including a snap fastener at the apex of the slit to reinforce this area where, typically, opposite ends of the strap meet and overlap. Another snap fastener is located at the midpoint of the inseam on each leg, about fifteen inches below the apex. At the bottom of the inseam, the strap 18 forms a transitional loop 22 that is riveted by a snap fastener, and another snap fastener is located about six inches from the center slit 26, toward the outside edge of each leg.

The strap 18 at the top edge of garment 12 carries a pair of shoulder straps 28 that are firmly connected to strap 18 near the center of the top edge, about four inches to each side of the center. Attachment may be by sewing or riveting. Each shoulder strap 28 has a free end that can be fastened to another area of the strap 18 by a suitable attaching means. Examples of attaching means include tying to the top corner loops, mating buckles, D-rings, hook-and-loop fasteners, snap fasteners, and the like. The corner loops 22 or any of the snap fasteners 24 at the top edge of garment 12 provide convenient attachment points.

The opposite side edges of the body garment 12 can be closed around a wearer. For this purpose, straps 18 at the upper side edges carry engageable upper zipper halves 30 near the top of the side edges. These zipper halves may have a length of about eighteen inches and are arranged with the zip-stop at the bottom end. Thus, the upper side edge zipper halves engage from top to bottom. The upper side edge zipper halves 30 are engageable with other zipper halves 30, whether on the opposite edge of the same suit 10 or on an edge of another suit 10.

The trouser leg portions of body garment 12 also can be closed. The side straps 18 on both the lower outer edges of the legs carry engageable lower side zipper halves 32. The straps 18 on the inside edges of each leg, at leg slit 26, carry similar engageable leg zipper halves 32. The zipper halves 32 along the outside and inside edges of each leg are substantially identical. These may have a length of about fifteen inches. The lower, leg zipper halves are arranged with the zip-stop at the bottom so that the leg zippers engage from top to bottom. The lower outside edge zipper halves are engageable with each other or with similar zipper halves on similar ghillie suits 10. The inside edge leg zipper halves are engageable with each other to open or close the leg slit 26. The inside edge and outside edge leg zipper halves are engageable with each other to form leg tubes.

FIG. 5 shows that alternative fastening means can be substituted for either the upper zippers 30 or the lower zippers 32. For example, elongated sheets of engageable hook-and-loop fastener 34 are attached to the strap 18 in place of the zippers 30, 32. The zippers or alternative fasteners are connected to strap 18 by a flange or seam allowance 36 that is sewn to the strap 18 and matrix 16 by sewing lines 20.

Figure 6:
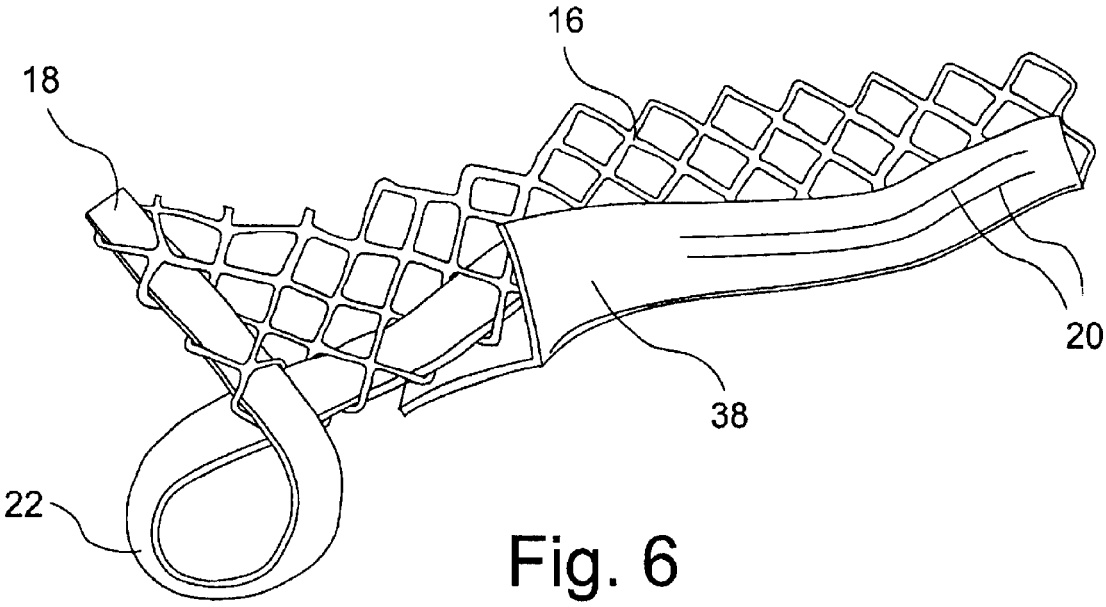
FIG. 6 is a fragmentary view of a corner of the mesh fabric, showing a peripheral strip configured as a corner loop and showing an optional a seam tape attached over the periphery of the mesh.

FIG. 6 shows that an alternative peripheral strengthening element 18 can be substituted for the strap or selected lengths of it. In the alternative arrangement, a nylon strap 18 is shown at the corner of net matrix 16, woven through the peripheral row of net openings as previously described. At a selected distance from the corner, the strap 18 is overlapped on both sides by the alternative, longitudinally folded covering strip 38, which may be, for example, a one-inch seam tape. The covering strip is sewn to the net 16, to the strap 18, and to itself by sewing lines 20. After a short length of overlap between the strap and the covering strip, the strap can be terminated and the seam tape 38 serves as the sole peripheral strengthening member over a continued portion of the net edge. As suggested by FIG. 6, the nylon strap 18 is the preferred peripheral strengthening member for use at corners and to form loops 22. The covering strip 38 is primarily useful along straight edges between the corner loops of garment 10. A covering strip 38 may offer a reduction in weight and a reduction in cost as compared to a nylon strap 18. Regardless of which perimeter element is used, or whether both are used in a combination, the perimeter element should remain substantially continuous: no perimeter location exposed to regular handling or field dangers should be without a perimeter element.

Figure 2:
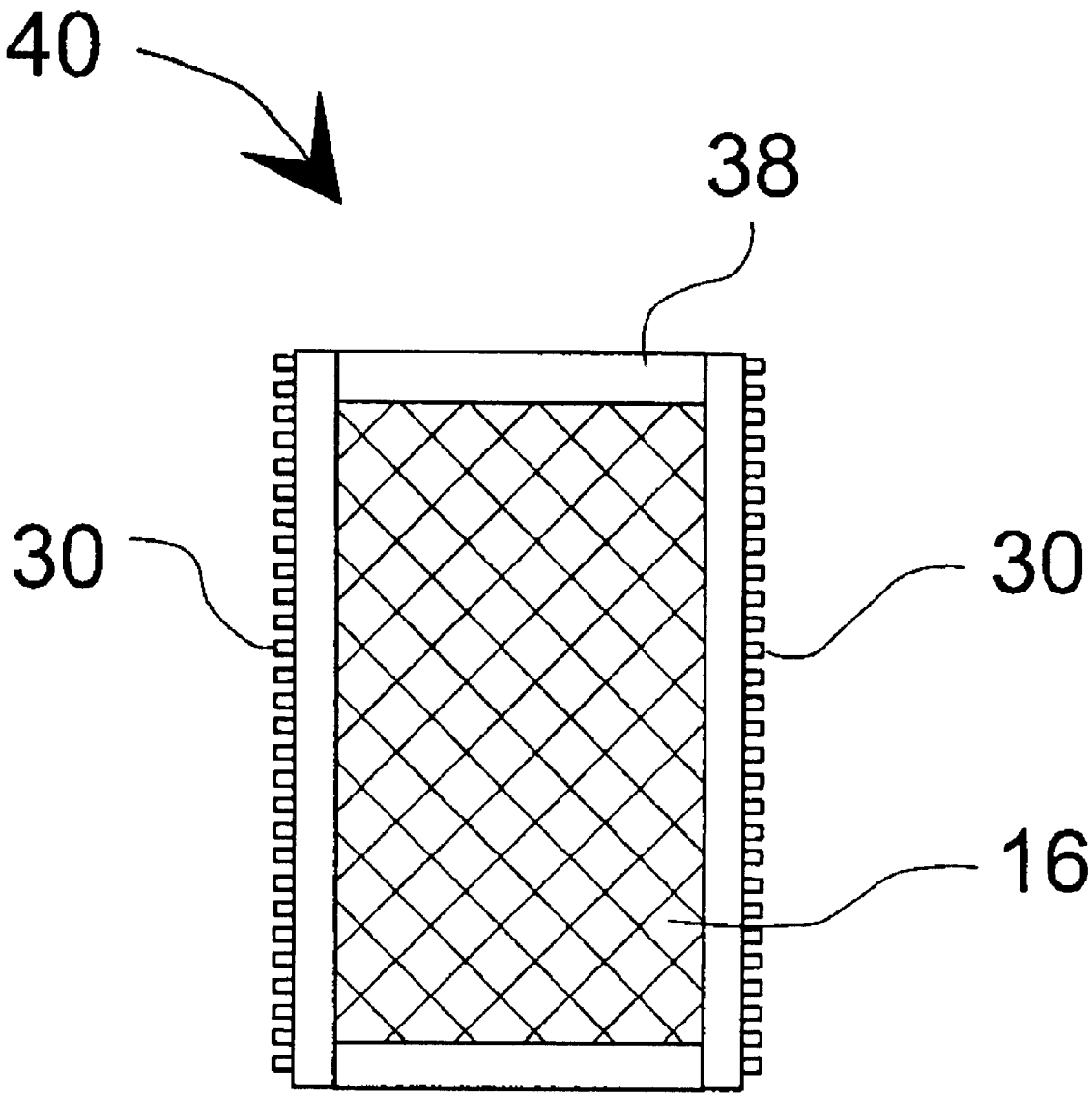
FIG. 2 is a plan view showing a breast piece insert.

To accommodate a variety of human body sizes, the garment 12 of suit 10 may be expanded by use of a supplemental breast piece 40, shown in FIG. 2. Side zipper halves 30 on the breast piece mate with zipper halves 30 of the garment 12, or alternative types of fasteners can be used, as described with reference to FIG. 6. The supplemental breast piece 40 can be sized to any desired width, such as four, six, or eight inches, to accommodate a wide variety of chest sizes. The structure includes a central piece of net 16 edged with a perimeter element 18 similar to the like-numbered element of the main ghillie suit. The border may be either a strap or the alternative seam tape 38 along the perimeter. The drawing shows seam tape 38 as representative, and this lighter duty type of perimeter element may be preferred since a breast piece is likely to see less severe use than the remainder of the suit 10.

Figure 3:
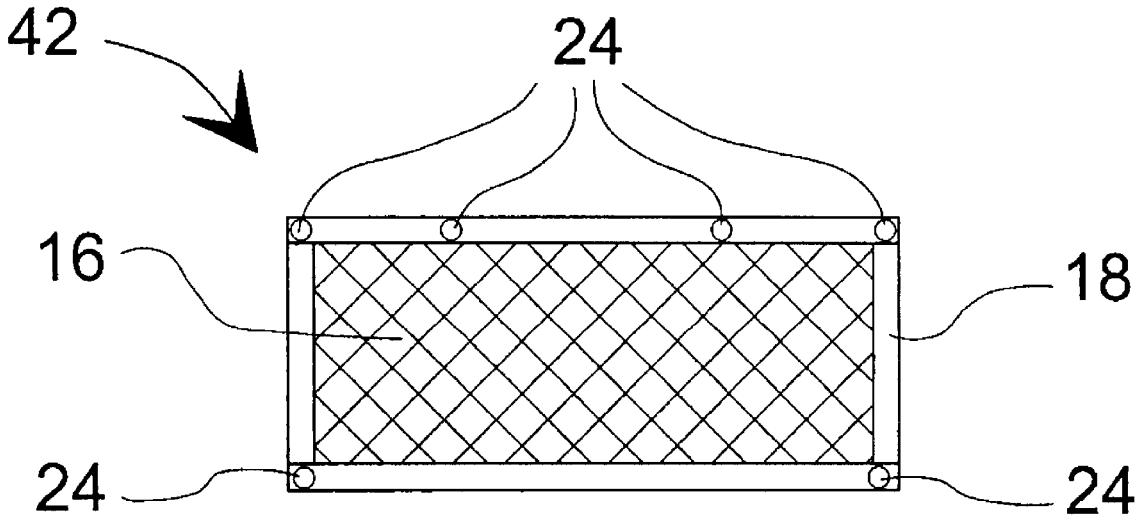
FIG. 3 is a plan view, showing a leg extension.

Other optional components include a pair of leg extenders 42. FIG. 3 shows a leg extender formed of net 16 bordered by perimeter element 18 such as a peripheral strap. Suitable snap fasteners 24 or other fasteners such as buttons attach a leg extender to the bottom of each leg section of the garment 12. A typical length of the extension, shown as the height of the extender 42 in FIG. 3, can be about four to six inches. This height is sufficient to accommodate different leg lengths or to cover a wearer's shoes in circumstances where full camouflage coverage is desired. The width is similar to the width of a leg section of garment 12.

Net 16 serves as the substrate for a three-dimensional camouflage layer of the ghillie suit 10 by carrying an array of elongated strips of camouflage material. For different environments, different types of camouflage strips can be selected. The camouflage strips should be applied to the net 16 in sufficient numbers and in suitable arrangement to define a three-dimensional camouflage layer. A three-dimensional layer can present disadvantages such as too much weight or inadequate ventilation. Consequently, the careful selection and arrangement of the camouflage strips can provide a solution to both problems. The strips should be sufficient to create a camouflage effect without preventing air circulation or overly weighting the suit 10.

One suitable selection and arrangement is directed to environments that have a bushy look. For these, bushy camouflage strips 44 are used. Each is formed with a wide and short profile. For example, each strip can be about one and one-half to two inches wide and ten to eleven inches long. Bushy strips 44 are tied to the net 16 at approximately every other opening, for example at an intersection or knot between net strings extending in perpendicular directions. This results in lengths of about four to six inches of camouflage strip material hanging from the outside of the net 16.

A net 16 typically is formed of square or diamond shaped patterns. Strings cross each other in approximately two directions, which can be approximately perpendicular directions, to form these patterns. Each corner of a pattern can be defined by a knot or other union between the crossing strings. The appearance of the net is that a single string 45 continues along a linear path having multiple knotted intersections between the approximately perpendicular strings, although it may be that a single string in fact zigzags through the net from the various knots. For purposes of description, the pattern of a net will be referred to as though a single string 45 follows a linear path or at least a linear path 45 can be identified, regardless of whether a single string defines the entire path.

Figure 4:
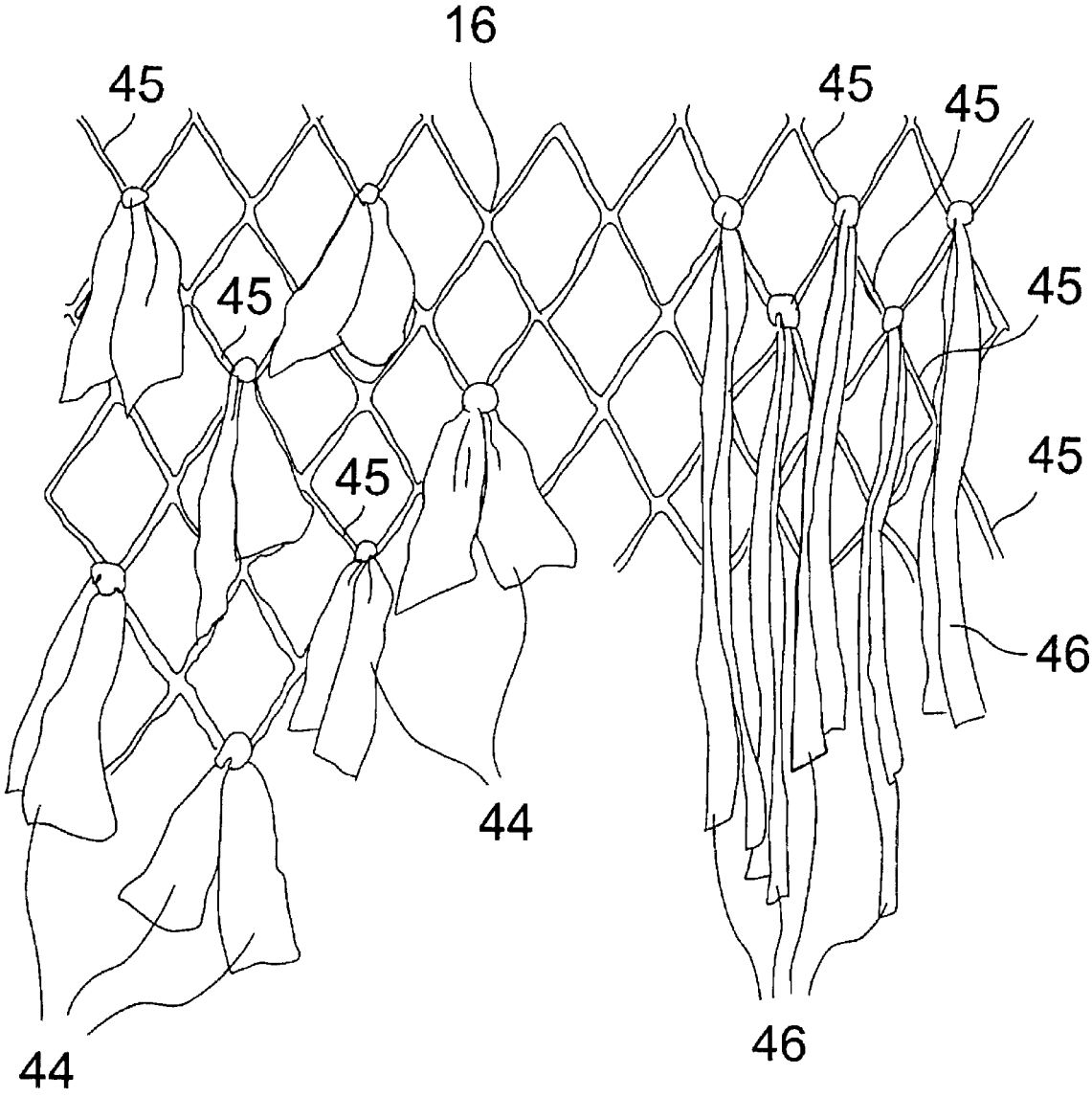
FIG. 4 is a fragmentary front view of the mesh fabric forming large areas of the ghillie suit and to varieties of camouflage strips attached to the mesh fabric.

Thus, FIG. 4 shows the implementation of a bushy camouflage appearance, with a pattern of bushy strips 44 attached along what appears to be a single, selected net string or linear string path 45 in the net pattern. A strip 44 is tied at every other intersection to what appears to be a crossing point of net strings along the selected liner path 45. The pattern is repeated at every second net string or linear path parallel to the selected path 45, such that the pattern is duplicated along both directions of the net fabric.

Another suitable selection and arrangement is directed to environments that have a stringy look. For these, stringy camouflage strips 46 are used. Each is formed with a narrow and long profile. For example, each strip can be from about three-quarter inch to one inch wide and fifteen to eighteen inches long. Stringy strips 46 are tied to the net at approximately every opening, for example to one corner intersection of the net strings defining each opening. This results in lengths of about six inches to ten inches of camouflage strip material hanging from the net. FIG. 4 shows the implementation of a pattern with stringy strips 46 following a single, selected net string or linear path 45. A strip 46 is tied at every intersection along the selected string. The pattern is repeated at every net string parallel to the selected one. Thus, the pattern produces a strip 46 tied to all intersections in two directions.

The main or outer suit 10 may benefit from having a liner 48. FIG. 7 shows a basic configuration for a liner, which is formed primarily of a selected special purpose fabric 50. The general configuration and size of the liner 48 is similar to the suit 10 as shown in FIG. 1. One desirable type is a slick liner that is worn under the suit 10 to protect against snags on other worn clothing or equipment that might be carried under the suit 10. The slick liner is formed of a lightweight, translucent fabric 50 such as sheer nylon or polyester. A similar fabric is used for the camouflage strips 44, 46. The liner includes both a lower garment portion 52 and a hood 54.

The peripheral edges of both liner portions are bounded by a fabric border 56, which may be formed of seam tape about one inch in width, as described with reference to FIG. 6. The tape carries snap fasteners 24, similar in position to the snap fasteners on suit 10. The tape also carries a plurality of optional fastening elements such as belts 58 at preselected locations along the border of each garment portion 52, 54. Each fastening belt 58 may be elastic fabric, about three-quarter inch wide and three and one-half inches long, and sewn to the border at its center. The opposite ends of each belt 58 carries hook-and-loop fasteners positioned to permit the opposite ends of the belt to be attached together to form a closed loop or ring. The fastening belts 58 can attach the liner 48 to the suit 10 by wrapping through the netting 16 and around the perimeter strap 18 of suit 10. FIG. 7 shows a suggested positioning of the belts 58 around the border 56 of liner 48. As a general guide, a fastening belt 58 is located between each pair of neighboring fasteners 24 on the peripheral element 56 of the liner 48.

The illustrated snap fasteners 24 on the liner border 56 can provide a ready substitute for the belts 58. The positions of these snap fasteners align with the snap fasteners 24 on the main suit 10 and provide another means for attaching the liner 48 to the main suit. As previously suggested, all snap fasteners 24 may be double headed, having both male and female sides. Thus, any number of layers can be attached together, and the liner and main suit can be combined with either one on the outside or inside.

Lower liner garment 52 accommodates the shoulder straps 28 on main garment 12 by providing suitably positioned slots 60 to receive and pass the shoulder straps.

In addition or substitution for a slick liner, the main suit 10 may include a rain liner or insulated liner. These may be configured as shown in FIG. 7. Nylon or vinyl is suitable material for the fabric 50 of a waterproof liner. Fleece and other insulating materials 50 are suitable for use in an insulating liner. A rain liner may be worn outside the main suit 10, if preferred.

A ghillie suit 10 can include additional accessories for any selected degree of camouflage effectiveness and user comfort. For example, a face or head cover of bag-like design can be constructed of translucent nylon similar to that used as fabric 50 of the slick liner. Thin nylon or polyester material allows the wearer to see and breathe through the fabric. Similar translucent material is suitable to form individual arm and hand covers. An accessory cover can be produced from the net material 16 with camouflage strips. Such a cover can be sized to be about two feet by two feet, which is suitable to disguise a rifle, a backpack, a camera, or other carried accessory.

Figure 8:
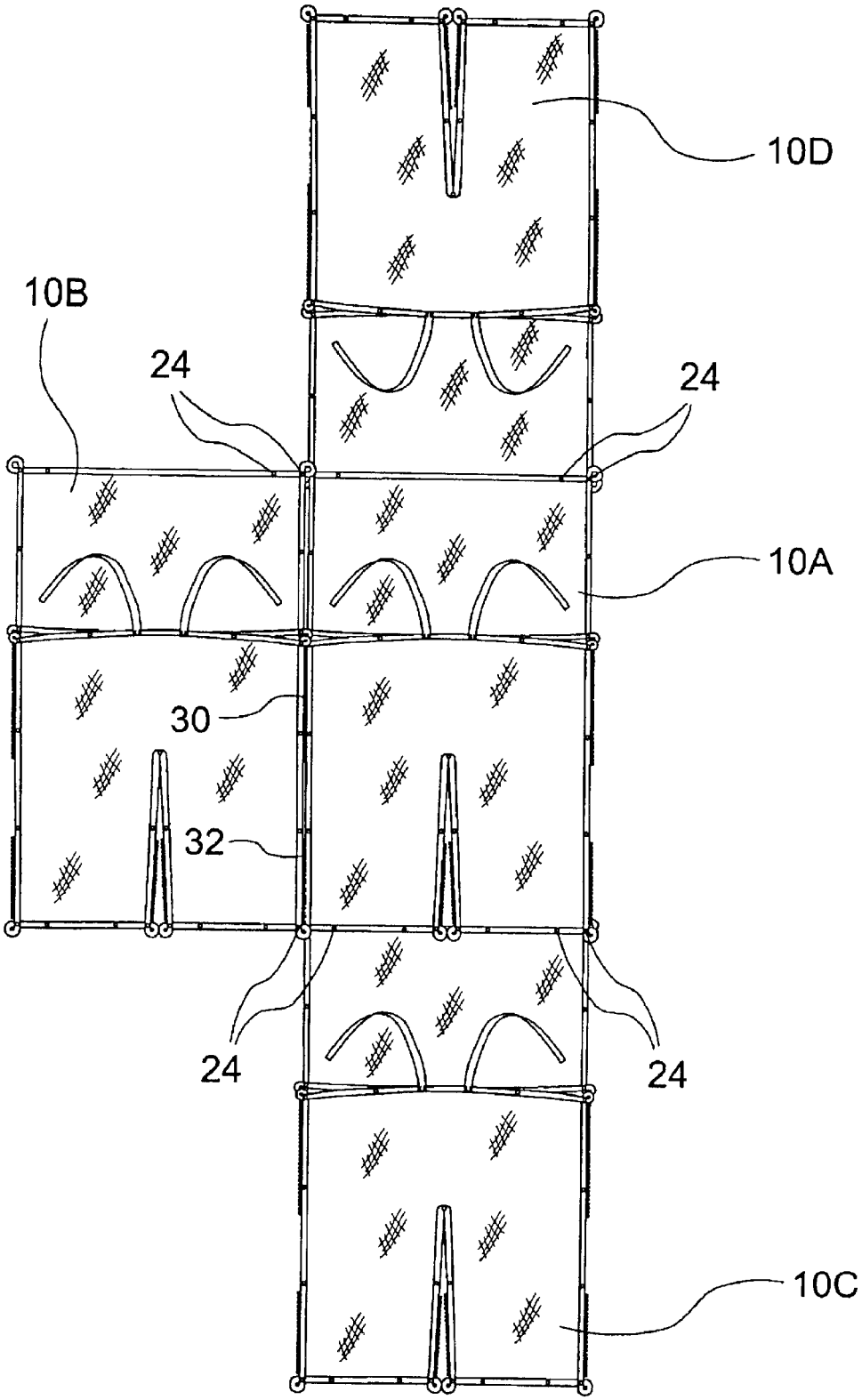
FIG. 8 is a plan view, showing optional assembly arrangements of a plurality of ghillie suits or liners.

The suit 10 can be attached to other like suits in any of several arrangements. FIG. 8 shows suits 10A and 10B in side-by-side arrangement. Suits 10A and 10C are in top-to-bottom arrangement. Suits 10A and 10D are in top-to-top arrangement. These arrangements employ the snaps 24 and zippers 30, 32 to connect the suits. A side-by-side attachment uses the juxtaposed zippers 30, 32 of neighboring suits to connect the lower portions 12. Snap fasteners 24 located, for example, at the top corners of juxtaposed hoods 14, connect the hood portions 14 in the side-by-side arrangement. Top-to-bottom connections and top-to-top connections employ snap fasteners 24 located, for example, at corner positions and the next inward to the corner.

The array of suits 10 in FIG. 8 can be expanded in any direction by any of the attachment methods made possible by the various fastening devices. The array can consist of either suits 10 or liners 48 or a mixture of the two, since the liners carry a similar number and arrangement of snap fasteners 24, as well as the optional fastening straps 58. Consequently, it becomes possible to form a large area camouflage cover from only a small number of ghillie suits and accessory components. The array can be formed in any shape and any necessary size without limitation on which relative way the suits 10 must be oriented. Further, in situations where ghillie suits might suffer damage, such as during prolonged field maneuvers, the presence of the durable perimeter element 18 helps to ensure that even torn and degraded suits can be fastened into the array.

Figure 9:
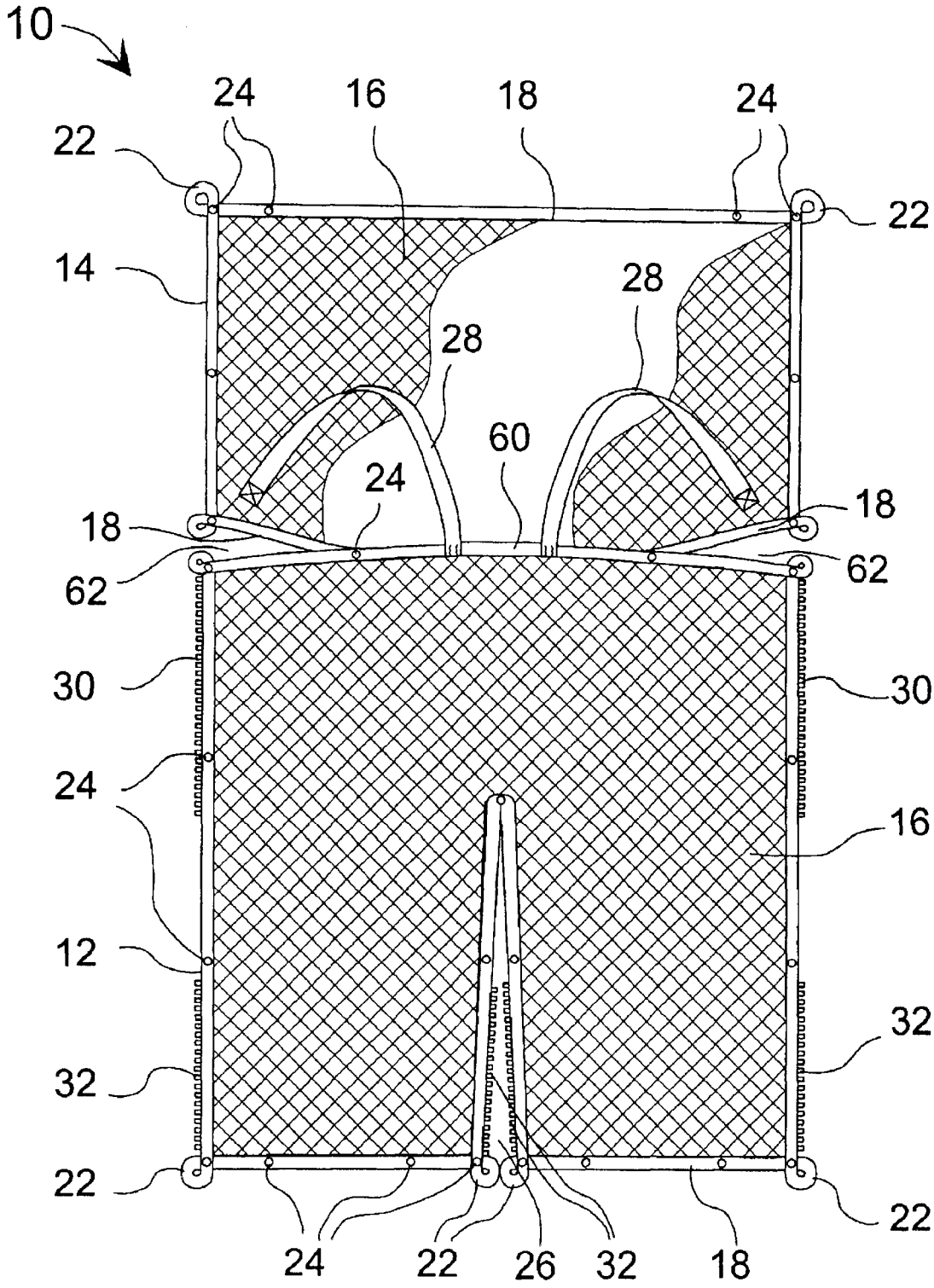
FIG. 9 is a plan view of a one-piece ghillie suit in a spread-out configuration, showing the inside face, a peripheral strip, spaced peripheral zippers, and spaced peripheral snap fasteners of the suit.

An alternative construction of the camouflage suit 10, as well as of the liner 48, is a one-piece construction best shown in FIG. 9. This variety of the suit is similar to the assembled construction of the suit shown in FIG. 1. The net fabric 16 may be a single sheet defining both the body 12 and hood 14 areas of the suit. In the one-piece construction, the top of the body portion 12, or correspondingly the bottom of the hood portion 14, is distinguished by a slit 62 at each side, extending from the side edge approximately to a snap 24 about one foot from the side edge. A perimeter band 60 or edge band extends across the entire boundary, from edge to edge, of either the body portion 12 or hood portion 14. The side of the slits 62 not bounded by the strap 60 are bounded by a band 18, which may be a continuation of the band 18 bounding other portions of the suit 10. For example, FIG. 9 shows band 60 on the body portion 12 of the one-piece suit, while band portions 18 bound the hood side of slit 62.

In use as a worn garment, the ghillie suit 10 of either FIG. 1 or 9 initially is laid out on the ground to allow arrangement and preparation. The inside surface faces up, and if necessary, the hood 14 is attached to the lower garment 12, as generally suggested by FIG. 1. The shoulder straps 28 are pre-attached at both ends to the lower garment 12 so that each strap is a closed loop. If a liner is to be used, the liner is connected to the inside face of the suit. The supplemental breast insert 40 or leg extenders 42 can be pre-applied or attached at a later time. If the suit is to be worn with legs, the center slit 26 is opened, while if the legs are not to be worn, the center slit can be closed using suitably located snap fasteners 24 or by engaging and closing zipper halves 32 bordering slit 26.

The suit is put-on by first bringing the shoulder straps 28 around the wearer's arms. The hood 14 initially is allowed to hang from the rear. Next, zip the leg zippers 32, and then zip the breast zipper 30. The hood then is brought over the head and shoulders to complete the camouflage system. Individual accessory items such as a head cover, arm covers, or accessory covers can be used and applied as the need arises.

The suit can be assembled with others from the laid out position. Single garment portions of the suit, the entire suit, and assemblies of a plurality of suits are best handled from the corner loops 22 or other attachments to the perimeter element 18. Thus, it seldom should be required or useful to lift or pull any part of the suit 10 from net 16.

The perimeter element 18 provides a strong anchor for accessory devices and handling points. The perimeter element also is effective to disperse applied forces over a large area of the net 16 so that the net does not readily suffer handling damage. Thus, the ghillie suit 10 is able to be strong, durable, and light in weight. It can be handled both for wearing and for other camouflage purposes by applying the handling and fastening forces to a strong, durable, and flexible peripheral element 18, which protects and preserves the net 16 from handling damage.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. An improved ghillie suit, comprising:

a net matrix defining the approximate shape of the ghillie suit;

a plurality of elongated strips of camouflage material attached to said net matrix in sufficient numbers and arrangement to define a three-dimensional camouflage layer;

a substantially continuous and flexible band engaged with said net matrix at the perimeter thereof and defining a handling loop located at a pre-selected perimeter location for receiving and dissipating handling forces over a broad area of said net matrix; and a plurality of inter-engageable mechanical fastening devices carried by said flexible band at positions spaced around the perimeter of the net matrix in a pattern of positions adapted for conforming the ghillie suit to a human wearer and also adapted for engaging the ghillie suit to one or more juxtaposed like ghillie suits.

2. The ghillie suit of claim 1, wherein:

said flexible band is of suitable width to be received through openings of said net matrix; and the band is engaged with the net matrix by weaving through openings of the net matrix.

3. The ghillie suit of claim 2, wherein:

said flexible band is engaged with the net matrix by sewing the band to the net matrix.

4. The ghillie suit of claim 1, wherein:

said flexible band comprises an elongated strip of material, folded longitudinally and receiving an edge of said net matrix within the fold; and the band is engaged with the net matrix by sewing the edge of the net matrix within the fold.

5. The ghillie suit of claim 1, wherein:

the edge of said net matrix defines a corner; and said flexible band forms a transitional loop at said corner, redirecting the band around the corner and providing a handling loop at the corner.

6. The ghillie suit of claim 5, wherein:

at least one of said mechanical fastening devices is carried by said flexible band at an intersection thereof at said transitional loop, securing together ends of the band forming the loop.

7. The ghillie suit of claim 5, wherein:

least one of said mechanical fastening devices comprises a snap fastener having rivet style attachment to said band; and said snap fastener is attached by said rivet style attachment through crossing ends of said band forming the transitional loop.

8. The ghillie suit of claim 1, wherein:

said inter-engageable mechanical fastening devices are selected from the group consisting of snap fasteners, zippers, hook-and-loop fasteners, and combinations thereof.

9. The ghillie suit of claim 1, wherein:

said net matrix defines a body garment portion of the ghillie suit and a hood portion of the ghillie suit:

said hood portion is generally rectangular and defines a top edge bounded by pair of top corners;

said body garment portion is generally rectangular and defines a top edge bounded by a pair of top corners, opposite side edges, and a bottom edge;

said flexible band extends along said top edge of the hood portion and forms a transitional loop at each of the top corners of the hood portion; and the flexible band extends along said top edge of the body garment portion and forms a transitional loop at each of the top corners of the body garment portion.

10. The ghillie suit of claim 9, wherein:

said body garment portion of the ghillie suit defines a partial upward leg slit from said bottom edge to define a pair of leg portions;

said flexible band engages the perimeter of the body garment portion at the side edges thereof and at the edges of said leg slit;

said fastening devices comprise leg zipper halves attached to said band at the opposite edges of said leg slit and lower side zipper halves attached to said band near the bottom edge of the body garment portion at the opposite side edges thereof, wherein:

the lower side zipper halves are engageable with each other whereby a plurality of adjacently arranged ghillie suits are attachable by the lower side zipper halves;

the leg zipper halves are engageable with each other whereby the leg slit is closeable; and each lower side zipper half is engageable with a juxtaposed leg zipper half to form a leg tube.

11. The ghillie suit of claim 9, wherein:

said flexible band engages the perimeter of said body garment portion at the side edges thereof;

said fastening devices comprise upper side zipper halves attached to said band near the top edge of the body garment at the opposite side edges thereof, whereby the body garment portion is closeable by engaging the upper side zipper halves.

12. The ghillie suit of claim 11, further comprising:

a breast piece formed of a piece of net fabric carrying camouflage strips, and a flexible border band on at least opposite side edges thereof;

a breast piece zipper half, carried on each side border band of the breast piece, engageable with said upper side zipper halves of said body garment portion for attaching the breast piece between the upper side zipper halves and closing the body garment.

13. The ghillie suit of claim 9, further comprising:

a pair of shoulder straps attached at one end centrally to said flexible band on the top edge of the body garment portion; and means for attaching the second end of the shoulder straps to the flexible band on the top edge of the body garment portion.

14. The ghillie suit of claim 1, further comprising:

a liner of substantially the same shape as said net matrix and carrying near the perimeter thereof a plurality of attachment belts having means for closing the belts to form a loop;

wherein said attachment belts are looped and closed around said flexible band to secure the liner in the ghillie suit.

15. The ghillie suit of claim 14, wherein:

said liner is formed of a camouflage print fabric.

16. The ghillie suit of claim 14, wherein:

said liner carries a plurality of fasteners, engageable with said mechanical fastening devices, at positions spaced around the perimeter of the liner in a pattern substantially matching the positions of the mechanical fastening devices, whereby the liner is engageable with one or more juxtaposed like ghillie suits or liners.

* * * * *